United States Patent [19]

Holman

[11] Patent Number: 4,845,604

[45] Date of Patent: Jul. 4, 1989

[54] SIGN LIGHTING LUMINAIRE

[75] Inventor: Curtis D. Holman, Vicksburg, Miss.

[73] Assignee: Cooper Industries, Inc., Houston, Tex.

[21] Appl. No.: 75,452

[22] Filed: Jul. 20, 1987

[51] Int. Cl.[4] ..... F21S 1/02

[52] U.S. Cl. ..... 362/431; 248/544

[58] Field of Search ..... 248/544, 479, 495; 362/431, 368, 145

[56] References Cited

U.S. PATENT DOCUMENTS

| | | | |
|---|---|---|---|
| 3,385,258 | 1/1967 | Curtin et al. | 362/431 X |
| 4,384,316 | 5/1983 | de vos et al. | 362/431 X |
| 4,388,680 | 6/1983 | Moore | 362/431 X |
| 4,522,363 | 6/1985 | Stuart | 248/544 X |
| 4,692,844 | 9/1987 | Galerne | 362/3 |

FOREIGN PATENT DOCUMENTS

| | | | |
|---|---|---|---|
| 682754 | 3/1964 | Canada | 362/431 |

*Primary Examiner*—Tony M. Argenbright
*Assistant Examiner*—Eric R. Carlberg
*Attorney, Agent, or Firm*—Eddie E. Scott; Alan R. Thiele

[57] ABSTRACT

A luminaire adapted to be mounted on a pole structure and having a roll axis with respect to that structure, said luminaire consisting of a plurality of elements each of which has a center of gravity positioned in relation to each other so as to contribute to the center of gravity of the luminaire, when mounted, being below, with relation to direction of gravitational pull, a point on the roll axis of the luminaire.

8 Claims, 6 Drawing Sheets

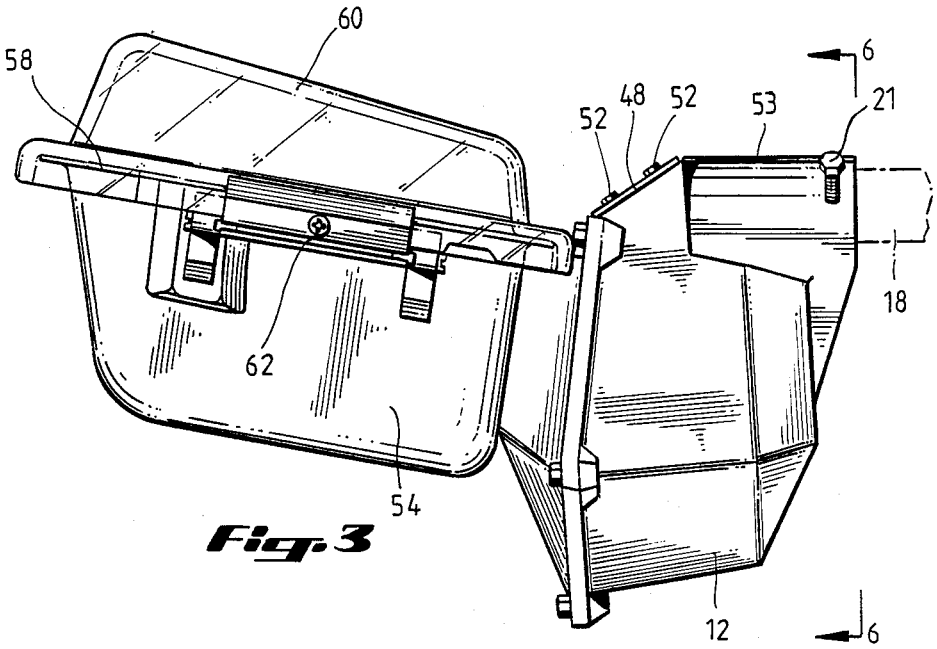
Fig. 3
Fig. 4
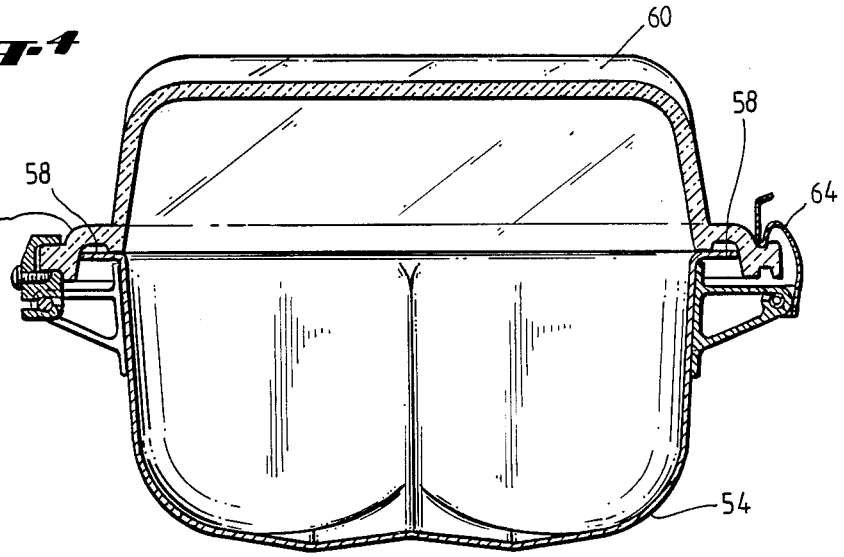

SIGN LIGHTING LUMINAIRE

BACKGROUND OF THE INVENTION

1. Field of the Invention

The present invention relates to luminaires and, more particularly, to luminaires for use in illuminating signs.

2. Statement of the Prior Art

It is frequently desirable to illuminate signs, such as outdoor billboards and poster panels, to make them more noticeable. A number of luminaires especially suitable for this purpose have heretofore been disclosed. One example may be seen in U.S. Pat. No. 4,451,875 to Odle et al.

Like the luminaire of the present invention, most of these prior art luminaires comprise housings in which are disposed various elements of differing sizes and weights, such as a high intensity discharge lamps and associated ballasts. Also, like the luminaire of the present invention, many prior art luminaires have substantially compact and symmetrical housings. Reasons for this include desires to save material, to minimize size of portions exposed to the elements, to facilitate shipment, and because of the aesthetics. From the foregoing, it should be appreciated that during design and construction of sign lighting luminaires, it is often necessary to dispose multiple elements of various shapes, sizes and weights into frequently small, symmetrically-shaped, outer housings. A result of this necessity, as well as other such obvious design considerations as needed to ensure that a desired quantity of light reaches a to-be illuminated sign, has been that prior art luminaires, notwithstanding any compactness thereof, have elements disposed within so as to conveniently fit, regardless of weight of those elements or how their weights interact or act upon the fixture as a whole. Accordingly, uniformly in prior art fixtures, weight distribution of the various elements is not uniform or predictable from one luminaire to another, nor is weight distribution fashioned within a luminaire to facilitate handling of the luminaire or positioning of the luminaire while being mounted. The ultimate result of these shortcomings of the prior art is that it is difficult for a single person to handle a luminaire and extremely difficult for a single person to position and, of necessity, simultaneously secure a luminaire to a typical luminaire mounting arm.

SUMMARY OF THE INVENTION

In order to overcome the above described shortcomings of the prior art, the present invention provides a luminaire which is easily positioned and secured to a luminaire mounting arm by a single person. This greatly enhances handleability of the luminaire of the present invention and gives it a considerable advantage over prior art sign lighting luminaires. Once positioned on the mounting arm, the luminaire holds itself in proper position while the person mounting the luminaire has both hands free to secure the luminaire to the arm.

The present invention provides such a luminaire by comprising a luminaire adapted to be mounted on a horizontal tenon or horizontal structure and having a roll axis with respect to that tenon or structure, said luminaire consisting of a plurality of elements each of which has a center of gravity positioned in relation to each other so as to contribute to the center of gravity of the luminaire, when mounted, being directly below, with relation to direction of gravitational pull, a point on the roll axis of the luminaire.

Accordingly, it is an object of the present invention to provide a luminaire that can easily be positioned and secured to a luminaire mounting arm by a single person.

Other objects, advantages and novel features of the invention will become apparent from the following detailed description of the invention when considered in conjunction with the accompanying drawings wherein:

DESCRIPTION OF THE DRAWINGS

FIG. 3 is a side view of the luminaire shown in FIG. 1;

FIG. 4 is a cross sectional view taken along line 4—4 of FIG. 2;

Figure 1:
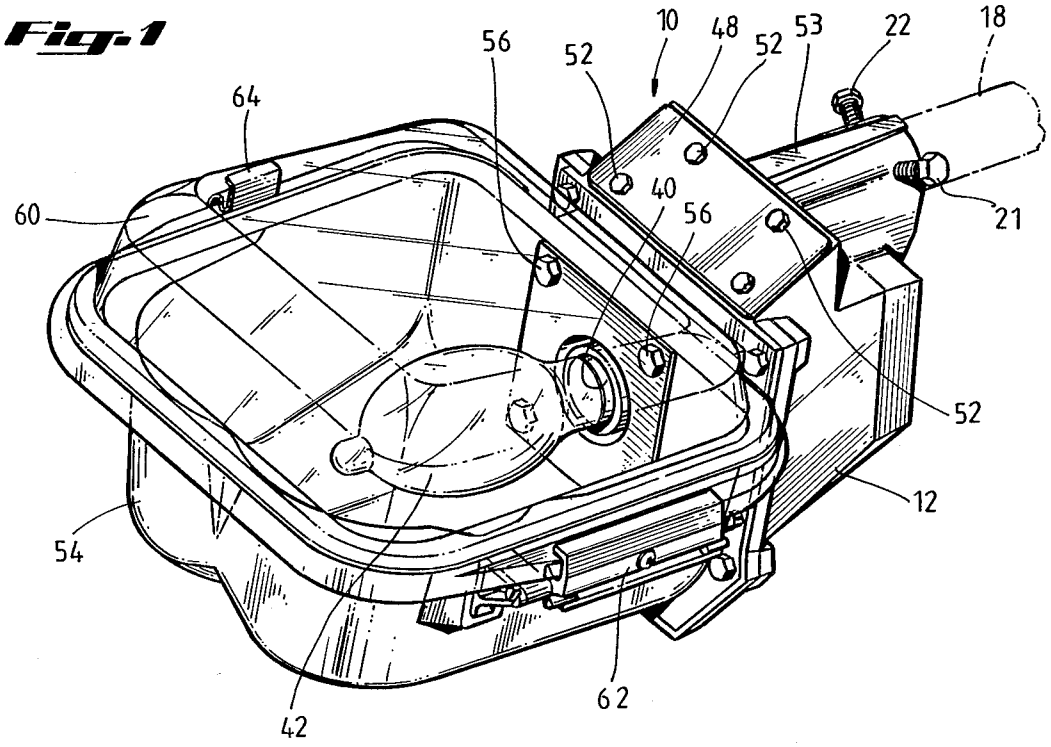
FIG. 1 is a perspective view of one embodiment of the luminaire of the present invention, said luminaire comprising a housing having a ballast capsule and a ballast capsule cover.
Figure 2:
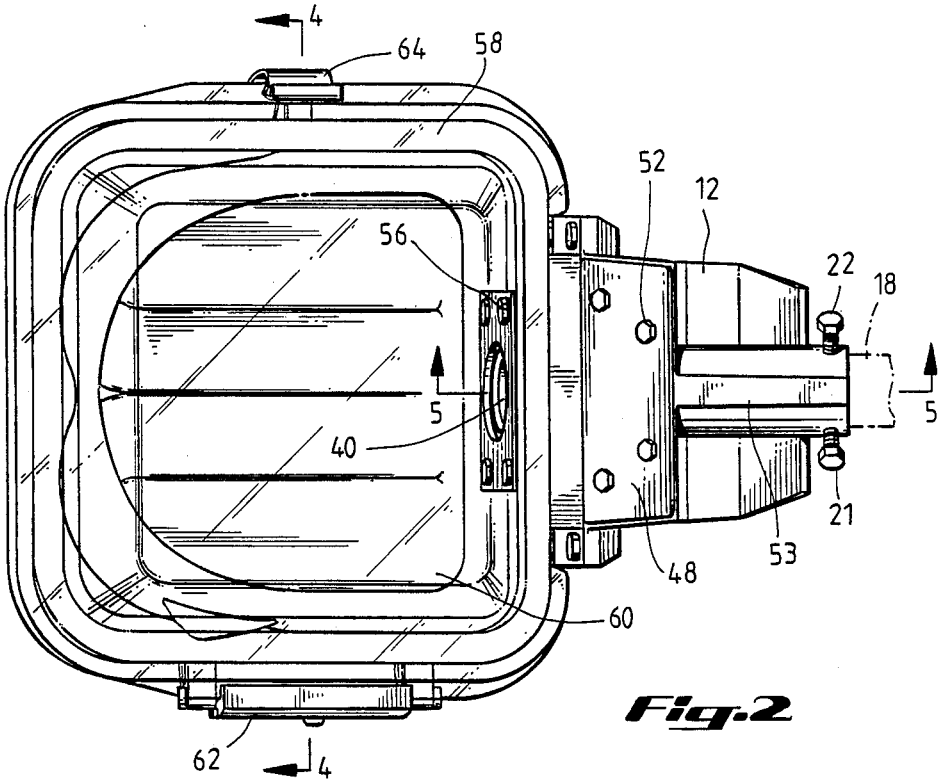
FIG. 2 is a top plan view of the luminaire shown in FIG. 1.
Figure 6:
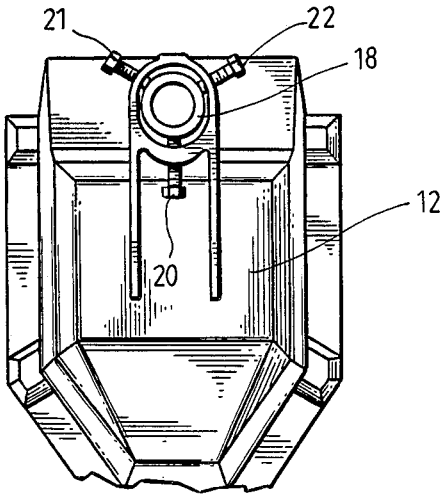
FIG. 6 is a view taken along line 6—6 of FIG. 3.
Figure 8:
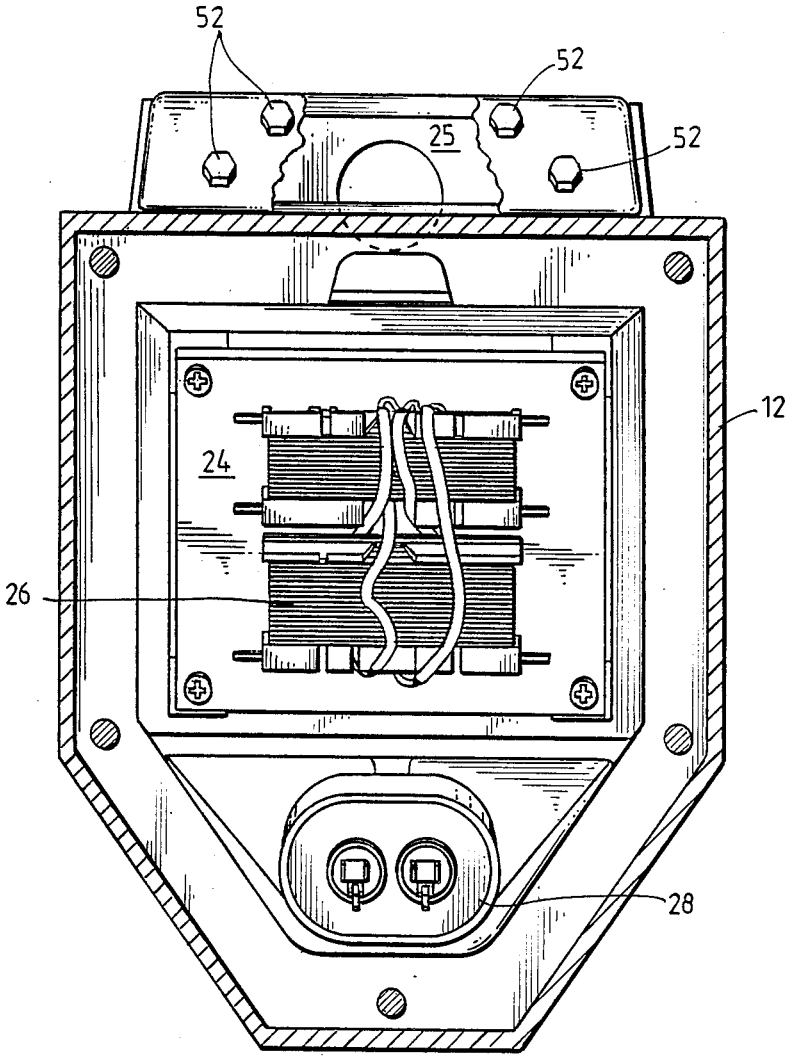

FIG. *7a* is a partial cross sectional view of the side of the luminaire shown in FIG. 1, this view showing the luminaire positioned on a mounting arm but not leveled;

FIG. *7b* is a partial cross sectional view of the side of the luminaire shown in FIG. 1, this view showing the luminaire positioned on a mounting arm and leveled; and FIG. 8 is a view into the ballast capsule of the luminaire shown in FIG. 1 with the ballast capsule cover removed.

DESCRIPTION OF THE PREFERRED EMBODIMENT

Figure 5:
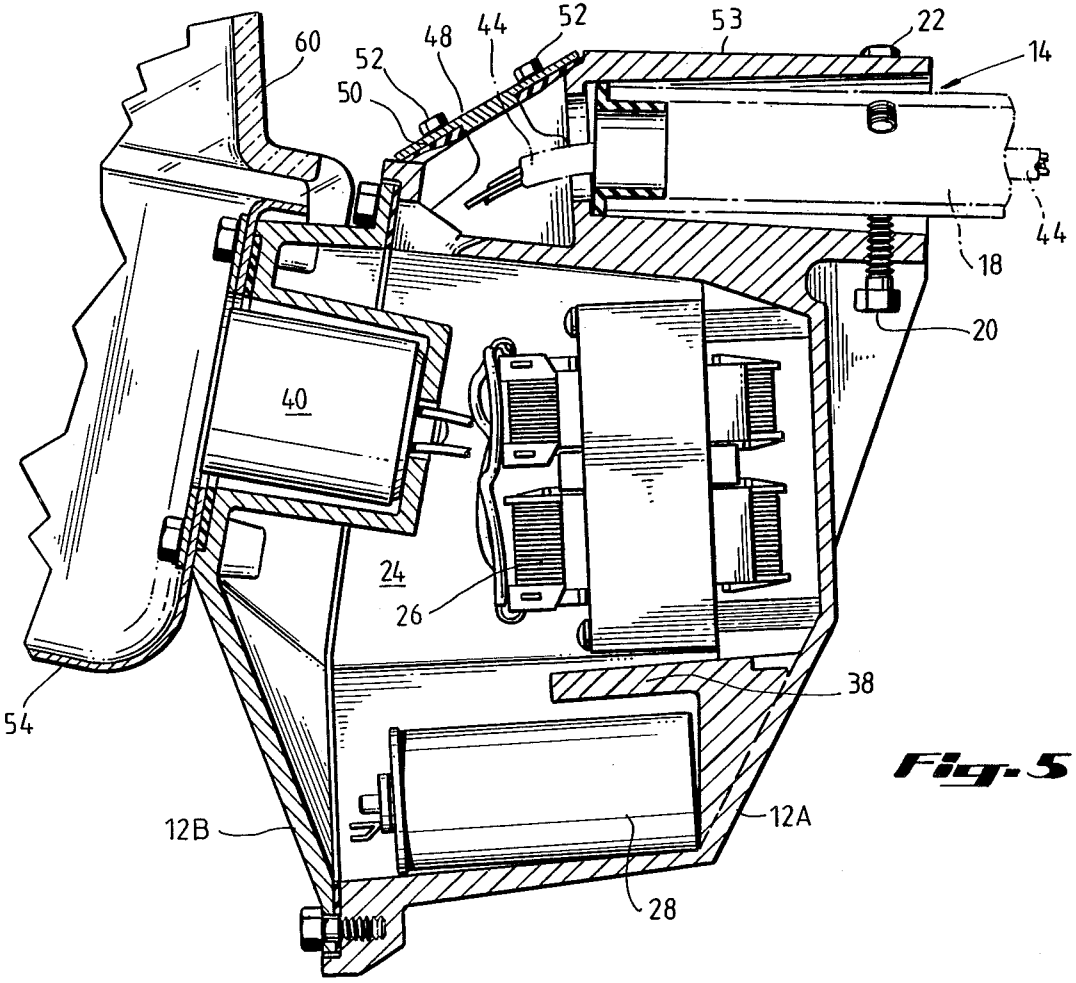
FIG. 5 is a cross sectional view taken along line 5—5 of FIG. 2.
Figure 7A:
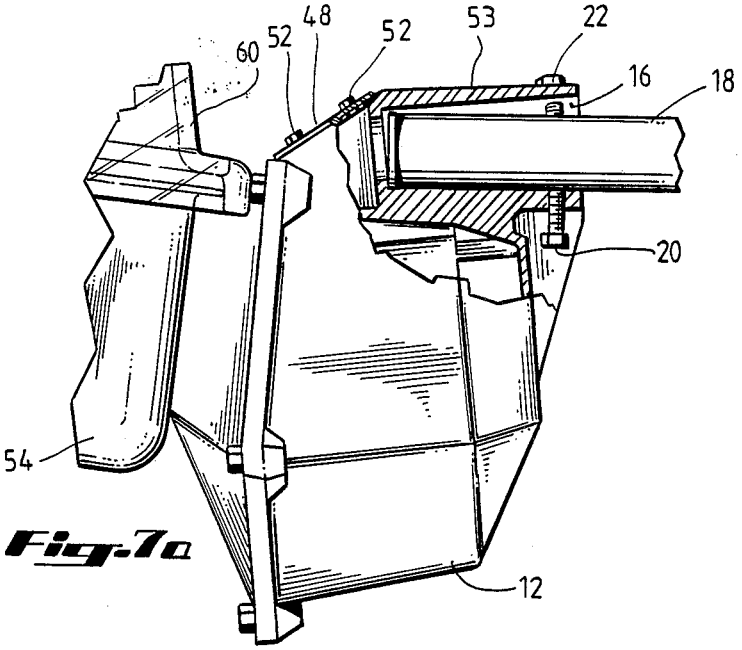
Figure 7B:
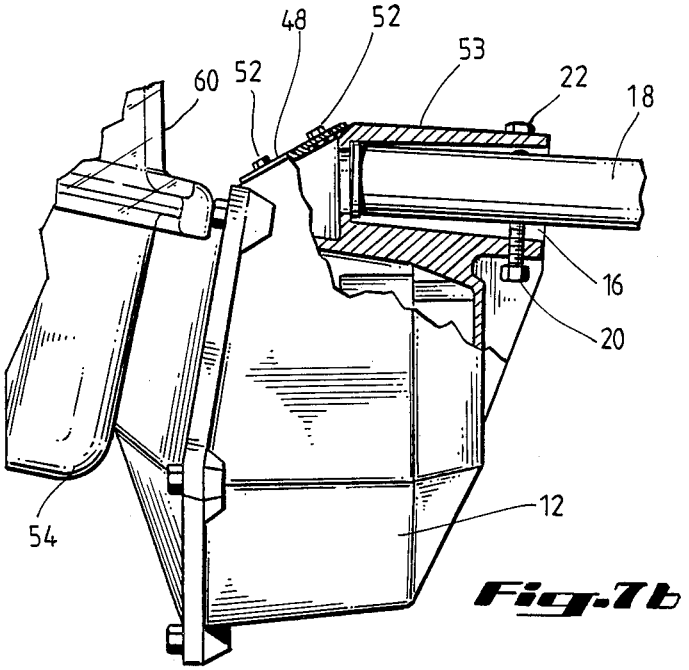

Referring now to the drawings wherein like symbols designate corresponding parts through the several views, there is illustrated in FIGS. 1 to 8, a luminaire, generally designated 10, embodying the present invention. Luminaire 10 comprises a housing, generally designated 12. Housing 12 may comprise any number of subportions. In the embodiment shown in the drawings, housing 12 has two major subportions: ballast capsule 12A and ballast capsule cover 12B. Ballast capsule 12A and ballast capsule cover 12B are best seen in FIGS. 3, 5, *7a* and *7b*. As can be best seen in FIGS. 6, *7a* and *7b*, housing 12 has luminaire support receiving means, generally designated 14, which further comprise a pipe receiving void 16 into which a pipe 18 or similar structure can be inserted and secured. In the embodiment shown in the various figures, pipe 18 is secured by three bolts 20, 21 and 22. Housing 12 further has a cavity or void 24 for containing lamp lighting means such as a ballast 26 and a capacitor 28. Void 24 and a ballast 26 and a capacitor 28 are best shown in FIGS. 5 and 8. With particular reference to those two figures, it may be noted that in the embodiment illustrated in the drawings, ballast 26 and capacitor 28 are separated by an interior housing wall 38. Such walls as interior wall 38 may be included in housing 12 of the present invention for weight distribution purposes discussed further below. Further, it should be noted that although interior wall 38 does not divide cavity 24 into subcavities, if it did so the results should not be considered to be outside the scope of the present invention. Housing 12 still further has an exteriorly facing socket 40 for receiving a lamp such as lamp 42 shown in FIG. 1. The various lamp lighting means, such as ballast 26 and capacitor 28, are electrically interconnected and further connected to socket 40 in any of a number of well known and conventional manners so that when power is applied to the luminaire 10, a lamp 42 in socket 40 will light. Referring to FIG. 5, it can be seen that power is supplied to the illustrated luminaire 10 via a wire 44 extending through pipe 18 and connected at its end opposite the luminaire to a conventional power supply (not shown). Of course, the luminaire of the present invention is not limited to this particular method of application of power from an external source; all methods of external powering are considered to be within the scope of the present invention. Housing 12 may be formed of cast metal or molded plastic or any other, preferrably weatherproof, material. Housing 12 may be of any shape and size provided that it can contain and support certain elements specifically mentioned above and below as well as other elements that may be incorporated into a luminaire to improve function or add features. For example, there is included in the illustrated embodiment of the present invention a cavity 25 formed by part of the exterior wall of the ballast capsule 12A and a cavity cover 48 having an associated gasket 50 and cover securing means such as screws 52. This feature facilitates splicing, that is, connection of wire 44 to the appropriate light powering means within the luminaire 10. Another feature of the luminaire 10 is a flat portion 53 designed to provide a surface for leveling measurements.

Luminaire 10 further comprises a reflector 54 formed of conventional material in a conventional manner so that when mounted on housing 12 by, for example, bolts 56, reflector 54 is positioned generally around all but one side of an inserted lamp 42. In the embodiment of the present invention illustrated in the drawings, reflector 54 can be seen to also have a refractor receiving surface upon which refractor 60 is mounted and secured by securing means comprising a hinge mechanism 62 and a latch mechanism 64. Of course, other securing means could be used. Reflector 54 and refractor 60 may have any shapes that can unite in an ideally weatherproof manner. Refractor 60 may be formed in a conventional manner of any number of known materials which allow light to pass therethrough and, most likely, would also include segments (not shown) for redirecting light to various areas of a billboard, poster panel or other sign to be illuminated so as to create a uniformly illuminated sign.

A key element of the present invention is that all elements of luminaire 10 are interpositioned so that their centers of gravity are so positioned in relation to each other so as to contribute to the center of gravity of the luminaire 10, when mounted or otherwise functionally supported, being below, with relation to direction of gravitational pull, a point on the roll axis of the luminaire. This means that luminaire 10 inherently seeks such balance when mounted on a stationary pole or pipe 18 that the only necessary adjustment would be a leveling adjustment made by movement of screw 20 as illustrated in FIGS. *7a* and *7b*. Further, this means that luminaire 10 need not be steadied or held in a particular position on pipe 18 when securing it to that pipe by tighting screws 20, 21 and 22. Accordingly, as should be readily appreciated by those skilled in the art, luminaire 10 is readily and easily mountable by a single person; which constitutes a significant improvement over the prior art. The proper development of the center of gravity of the luminaire 10 can be accomplished by varying positioning of constituent elements, varying materials used to construct various constituent elements, by including unnecessary elements such as interior wall 38, or by any number of other known methods of causing increases or decreases in weight at particular points within a device and, accordingly, change in position of the center of gravity of the device.

Obviously, numerous modification and variations of the present invention are possible in light of the above teachings. For example, the preferred embodiment is described as having a reflector completely outside of the housing. This was done to minimize weight; more commonly, luminaires have large housings that surround at least some portion of a reflector. Lower weight, of course, facilitates handling which is a key goal of the luminaire of the present invention. However, any luminaire, including those having housings surrounding at least some portion of a reflector, may be modified so as to come within the claims of the present invention. It is to be understood therefore, that within the scope of the appended claims, the present invention may be practiced otherwise than is specifically described hereinabove.

I claim:

1. A luminaire adapted to be mounted axially on a pole structure having a radial roll axis with respect to that structure, said luminaire consisting of:

A plurality of elements each of which has a center of gravity positioned in relation to each other so as to contribute to the center of gravity of the luminaire when mounted, being directly below and substantially radially balanced, with relation to the direction of gravitational pull, to a point on the radial roll axis of the luminaire.

2. The luminaire of claim 1 wherein said plurality of elements comprises:

a housing having luminaire support receiving means, a cavity for containing lamp lighting means, an externally facing socket;

a lamp held in the externally facing socket;

a reflector, positioned on one side of said lamp, mounted on said housing, and having a refractor receiving surface;

a refractor positioned on the refractor receiving surface; and lamp lighting means positioned within said housing cavity.

3. The luminaire of claim 2 further comprising:

means for securing said refractor to said reflector.

4. The luminaire of claim 3 wherein said housing further has interior walls.

5. The luminaire of claim 4 wherein said further interior walls in said housing effectively form cavities.

6. The luminaire of claim 3 further comprising a housing cover and wherein said housing further has an opening therethrough, said opening coverable by said housing cover.

7. The luminaire of claim 3 wherein said housing further has a generally flat horizontal surface when mounted but not secured to a pole structure and subjected to gravitational pull.

8. A luminaire comprising:

a housing having luminaire support receiving means, a cavity for containing lamp lighting means, and an externally facing socket;

a lamp held in the housing socket;

a reflector positioned on one side of said lamp, mounted on said housing, and having a refractor receiving surface;

a refractor positioned on the refractor receiving surface;

lamp lighting means positioned within said housing cavity; and means for securing said refractor to said reflector;

each of the foregoing elements having centers of gravity so positioned in relation to each other so as to contribute to the center of gravity of the luminaire, when supported, being directly below, and substantially radially balanced with relation to the direction of gravitational pull, a point upon the roll axis of the luminaire.

* * * * *